US006989482B2

(12) United States Patent
Goto

(10) Patent No.: US 6,989,482 B2
(45) Date of Patent: Jan. 24, 2006

(54) STRINGED INSTRUMENT STRING WINDER AND METHOD OF MANUFACTURING THE CHORD WINDER

(75) Inventor: Takao Goto, Isesaki (JP)

(73) Assignee: Gotoh Gut Co., Ltd., Isesaki (JP)

( * ) Notice: Subject to any disclaimer, the term of this patent is extended or adjusted under 35 U.S.C. 154(b) by 6 days.

(21) Appl. No.: 10/451,789

(22) PCT Filed: Jan. 12, 2001

(86) PCT No.: PCT/JP01/00166

§ 371 (c)(1),
(2), (4) Date: Jul. 11, 2003

(87) PCT Pub. No.: WO02/056291

PCT Pub. Date: Jul. 18, 2002

(65) Prior Publication Data

US 2004/0060419 A1 Apr. 1, 2004

(51) Int. Cl.
*G10D 3/14* (2006.01)

(52) U.S. Cl. ..... 84/304; 84/306

(58) Field of Classification Search ..... 84/304, 84/306, 305
See application file for complete search history.

(56) References Cited

U.S. PATENT DOCUMENTS

| | | | | |
|---|---|---|---|---|
| 941,196 | A * | 11/1909 | Harmer | 84/306 |
| 3,564,573 | A | 2/1971 | Wüstl et al. | 84/306 |
| 3,982,462 | A | 9/1976 | Schaller | 84/306 |
| 4,528,887 | A | 7/1985 | Frederick | 84/306 |
| 6,233,825 | B1 * | 5/2001 | DeGroot | 29/896.22 |

FOREIGN PATENT DOCUMENTS

| | | |
|---|---|---|
| CN | 2116045 U | 9/1992 |
| JP | 48-95810 | 12/1973 |
| JP | 54-59126 | 5/1979 |
| JP | 54-29093 | 9/1979 |
| JP | 62-2014 | 1/1987 |
| JP | 7-43538 | 8/1995 |

* cited by examiner

*Primary Examiner*—Shih-Yung Hsieh
*Assistant Examiner*—Jianchun Qin
(74) *Attorney, Agent, or Firm*—Armstrong, Kratz, Quintos, Hanson & Brooks, LLP

(57) ABSTRACT

A peg for a stringed instrument is provided, The peg has a main body 10; a pair of bearings 12 erected at two sides of the main body so as to oppose each other, a worm gear 21 which is rotatably supported in a large diameter hole 15 and a small diameter hole 16 which has a knob 29 on one end portion, and a winding shaft 30 which is connected to the worm gear 21 via a worm wheel 40. The bearing 12 is formed of a material having spring-like properties and thus has increased elastic limit and avoids deformation.

6 Claims, 5 Drawing Sheets

STRINGED INSTRUMENT STRING WINDER AND METHOD OF MANUFACTURING THE CHORD WINDER

BACKGROUND OF THE INVENTION

1. Technical Field

The present invention relates to a winding device for a stringed instrument such as a guitar, and relates to a manufacturing method therefore, and more particularly, the present invention relates to a technique for decreasing backlash of gears by preventing the generation of play in a worm gear and a bearing.

2. Background Art

FIG. 9 shows an example of a peg for a conventional classical guitar. As shown in this figure, a worm gear 3 having a knob 2, fixed to one end thereof, is rotatably supported on a main body 1 which is mounted to the guitar head. A worm wheel 4 meshing with the worm gear 3 is rotatably supported on the main body 1, and a winding shaft 5 which is coaxial with respect to the worm wheel 4 is mounted to the worm wheel 4 by a screw 6.

An ordinary steel plate is press molded and a plurality of bearings 7 are formed so as to be bent at an angle substantially equal to 90 degrees and is erected on the main body 1. The side of the shaft receiving portion is open so as to have a U-shaped recessed portion 7*a*. Grooves 3*a* which are formed in both end portions of the worm gear 3 engage with the recessed portion 7*a* and thereby support both end portions of the worm gear 3.

In addition, the wall portion of the worm gear 3 is nipped from both sides by two bearings 7 and 7, and hence resistance is given to the rotation of the worm gear 3 and this thus prevents rotation in the reverse direction (rotation causing loosening of the string). In the PEG, a string is wound on the winding surface 5*a* of the winding shaft 5, and the tuning of the stringed instrument is performed by rotating the knob 2 so that the string is wound or unwound.

However, in the PEG described in the foregoing, the backlash of the worm gear 3 and the worm wheel 4 is large. Furthermore, because the backlash gradually increases as the instrument is used, tuning becomes more difficult, and this may cause decreased performance.

That is to say, the side of the bearing 7 of the peg described in the foregoing is open, and thus its assembly is simple. However, in order to achieve this simple assembly, a large clearance must be provided between the worm gear 3 and the worm wheel 4, and the worm gear 3 is movable with respect to the worm wheel 4 according to the size of the clearance. As a result, the backlash between the worm gear 3 and the worm wheel 4 is large. Therefore, when the knob 2 is rotated by a small amount, the winding shaft does not rotate, and therefore fine tuning is difficult.

Furthermore, when the worm gear 3 as viewed from the side shown in FIG. 9 is rotated in a clockwise direction, the moment of the clockwise rotation having a center at the point P shown in FIG. 3 is added to the worm gear 3, and thus the worm gear 3 moves to the worm wheel 4 side. As a result, the seizure of teeth surfaces of both the worm gear 3 and the worm wheel 4 cause the teeth surfaces to wear and the backlash of the gears is even larger. Furthermore, in the peg described above, since the bearing 7 is formed of a ordinary steel plate which is low in strength, and also since the side of the bearing 7 is open, less of the wall portions can be supported than in comparison with the bearing of a round hole.

On the other hand, in consideration of bearing manufacturing error and ease of assembly, the grooves 3*a* of the worm gear 3 are made wider than the thickness of the bearing 7. As a result, due to the thrust load received from the worm gear 3, the bearings 7 and 7 which initially nipped the grooves 3*a* and 3*a* of the worm gear 3 from both sides, are deformed and open up. Consequently, the worm gear 3 also becomes movable in the thrust direction (axial direction). In a case in which a play is formed in the thrust direction, even when the worm gear 3 is rotated, it continues to idle until the groove 3*a* comes into contact with the bearing 7. Thus, the play in rotating the knob 2 is large, and tuning is extremely difficult.

Furthermore, when there is play at the worm gear 3 and the bearing 7 and the worm gear 3 is in a free state, the vibrations of the string may be transmitted to the worm gear 3, thereby causing an unusual noise during performance. The worm gear 3 rotates in the opposite direction due to the vibrations, and thus the notes become out of tune.

If the bearing is made so as to have a round hole, the worm gear 3 is prevented from moving in the direction of the worm wheel 4, and the problem of the large backlash as well as the problem that the backlash is increased due to the wear of the teeth surfaces are solved. However, although the strength of the bearing is increased because it is made to have a round hole, this alone does not sufficiently prevent transformation caused when the worm gear receives the thrust load. Accordingly, the problems of the generation of play due to the deformation of the bearing and the generation of unusual noises caused by this deformation, and of reverse rotation of the worm gear, remain unsolved.

In an effort to solve these problems, a peg is provided in which the main body and the bearing are formed separately and both parts are joined together by a welding or calking process. In this type of peg, each of the bearings is completely nipped at both sides using the flange, the washer, and the screw formed on the worm gear. In this type of peg, the thrust load in all directions is supported on a pair of bearings, and thus the resistance of transformation of the bearing is high. However, in this bearing, it is necessary to provide many parts in order to nip the respective bearings, and it is also necessary to carry out a calking process for preventing disengagement of the worm gear. Thus, there is a problem in that the number of processes to be carried out in assembly is increased.

In addition, examples of the peg which has been integrally formed by press molding the main body and the bearing, include those in which a ring is rotatably supported at one end of the worm gear, and a screw which is formed at the outer periphery of the ring is screwed together with a screw formed at the inner periphery of the bearing. In the peg having this type of structure, the ring is moved and the worm end surface of the worm gear is pressed with force, and thus the bearing can be secured to the worm gear so as to open to the outer side, and the play of the bearing and the worm gear in the thrust direction is eliminated. In addition, there is also an example in which a screw is formed on a shaft of a worm gear and a bearing is secured to the worm gear with a ring which engages with the screw. However, in this type of peg as well, the number of complicated parts is increased, and the manufacturing cost is relatively high.

An object of the invention is to provide, without significantly increasing the manufacturing cost, a peg in which the deformation of the bearing in the thrust direction is controlled, the play of the worm gear and the bearing in the thrust direction is eliminated, and accordingly, tuning is carried out easily, and problems of the generation of unusual noises and reverse rotation of the worm gear do not occur.

SUMMARY OF THE INVENTION

The present invention provides a peg, for a stringed instrument, having a main body for mounting to a head portion of the stringed instrument; a pair of bearings integrally formed with the main body and erected at both sides of the main body so as to oppose each other; a worm gear having two ends which are rotatably supported in round holes disposed so as to oppose each other on the pair of bearings, a knob provided at an end portion of the worm gear, and a winding shaft connected to the worm gear via a worm wheel, the bearing being formed of a material having spring properties (elastic properties).

In the peg having the above-described structure, the bearing is formed of a material having spring properties and has a round hole, so that even when a thrust load is applied from the worm gear, the bearing is not deformed easily. Accordingly, formation of play between the worm gear and the bearing can be inhibited, and thus the problems of increased backlash and unusual noises, and problems in tuning resulting from reverse rotation of the worm gear, can be inhibited.

Examples of the spring material used here of course include a stainless steel plate for forming springs, spring steels (SUP) and phosphor bronze for forming springs. Also, ordinary materials which have been subjected to heat processing and the like in order to increase the elastic limit may be used. For example, by using a ordinary steel plate such as a cold rolled soft steel plate (SPC) material which has been subjected to a carburizing process to a depth of preferably 0.05 to 0.3 mm from its surface and more preferably 0.1 to 0.15 mm from its surface, so that the tension is increased and the elastic limit is also increased, thus imparting a spring properties to the steel plate. Alternatively, a ordinary steel plate which has been subjected to nitration or carbonitration may be used. However in cases in which these materials are used, the elastic limit (spring properties) is insufficient, and plating processes become difficult. Therefore, it is preferable to carry out a carburizing process. It should be noted that it is sufficient for only the bearing (including those portions that border the main body) to be subjected to the carburizing process.

The bearings are inclined with respect to the base portion so as to open slightly outwards in a direction in which they are erected, and a tightening device for tightening the bearing to the worm gear from both sides thereof are provided at both ends of the worm gear.

In this embodiment, by the bearing being secured to the worm gear with the tightening device, the bearing deforms elastically, and due to the counter force caused by the spring properties of the bearing, frictional resistance is given between the bearing and the worm gear. As a result, play in the thrust direction of the bearing and the worm gear is eliminated, and when the knob is turned, a suitable amount of resistance is generated, and tuning can be easily performed.

Furthermore, even if vibrations are transmitted to the worm gear, problems such as unusual noises and reverse rotation of the winding shaft can be inhibited. In addition, by securing the outward opening bearings to the worm gear in advance, the bearings are parallel, or substantially parallel, to each other, and thus the counter force due to the spring property acts directly in the axial direction, and the frictional resistance with respect to the worm gear is efficiently generated. Furthermore, the worm gear is fit into the round hole of the bearing when the hole is completely round, and thus the characteristics of the bearing can be favorably maintained. It should be noted that the angle of inclination of the bearing with respect to the plane perpendicular to the main body is preferably in a range of 0 to 6° for obtaining a suitable securing force.

More specifically, the tightening means preferably comprises a flange portion disposed at a base end portion side of the worm gear and a push nut which is press-inserted into a leading end of the worm gear, the leading end of the worm gear and the groove extending along a peripheral direction thereof, the groove engages with an inner periphery of the push nut.

It is more preferable that plural grooves of this type be provided. The push nut generally has a washer member whose center is concave in the thickness direction thereof, and has slits formed radially from the center. The shaft can be inserted through the center of the push nut in the direction in which the slits open, but in the opposite direction, the slits are closed and the push nut engages with the shaft and cannot come out therefrom.

On the other hand, the worm gear is generally used after being subjected to a plating process, and thus the coefficient of friction is usually low and there is a possibility that the push nut may be disengaged from the worm gear. Thus, as described above, it is preferable that the leading end of the worm gear be formed so as to be engaged with the inner periphery of the push nut. As a result, the worm gear is prevented from becoming disengaged from the bearing, and the setting of the securing force in the thrust direction can be carried out in a single operation, thus reducing the number of steps in the assembly process.

In addition, by serially disposing a plurality of grooves, the securing force can be suitably adjusted in the thrust direction, and the groove positions and the interval between the respective grooves (for example, 0.1 mm) can be severely controlled. By standardizing such that the push nut which will be engaged with a particular groove has predetermined characteristics, the securing force in the thrust direction of the bearing can be made uniform, thereby stabilizing the quality of the product. Furthermore, even if the bearing deforms towards the inner side, the push nut can be tightened even further, thereby eliminating play of the worm gear and the bearing.

The bearing side surface of the flange portion provided at the base end side of the worm gear may be at right angles with respect to the shaft, or may be tapered so as to correspond to the incline of the bearing. In addition, it is desirable that a synthetic resin washer or a metal washer having a lubricating coating on a surface thereof, be placed between the flange portion and the bearing, and between the push nut and the bearing. As a result, contact of the metal surfaces is prevented, and the worm gear is not heated due to surface seizure when rotated. Consequently, a soft and smooth feel can be obtained when tuning is being carried out.

The material for the washer may be can a synthetic resin including a polyacetal resin having 10% or more by weight of polytetrafluoroethylene, a metal washer having a solid lubricant such as molybdenum disulfide or the like coated on the surface thereof, or a metal washer whose surface was plated and subsequently coated with a Teflon (trademark) mixture film.

The peg is preferably manufactured by a method having the steps of press forming a plate metal composed of an ordinary steel plate so as to from a main body in which bearings having round holes are erected from both sides thereof so as to oppose each other, subjecting the main body to carburization, and a finishing process such as plating, and rotatably mounting to the bearing having the round holes, a worm gear having a knob at one end thereof, mounting a winding shaft including a worm wheel meshing with the worm gear to the main body. In this manufacturing method, since an ordinary steel plate is molded, material cost is considerably lower than in the case in which material for forming springs is used. In addition, since the material used is not an ordinary steel plate which has been formed into a spring or is carburized, the processing cost also is considerably lower.

BEST MODE FOR CARRYING OUT THE INVENTION

The following is a description of embodiments of the present invention with reference to FIGS. 1 to 6.

Figure 1:
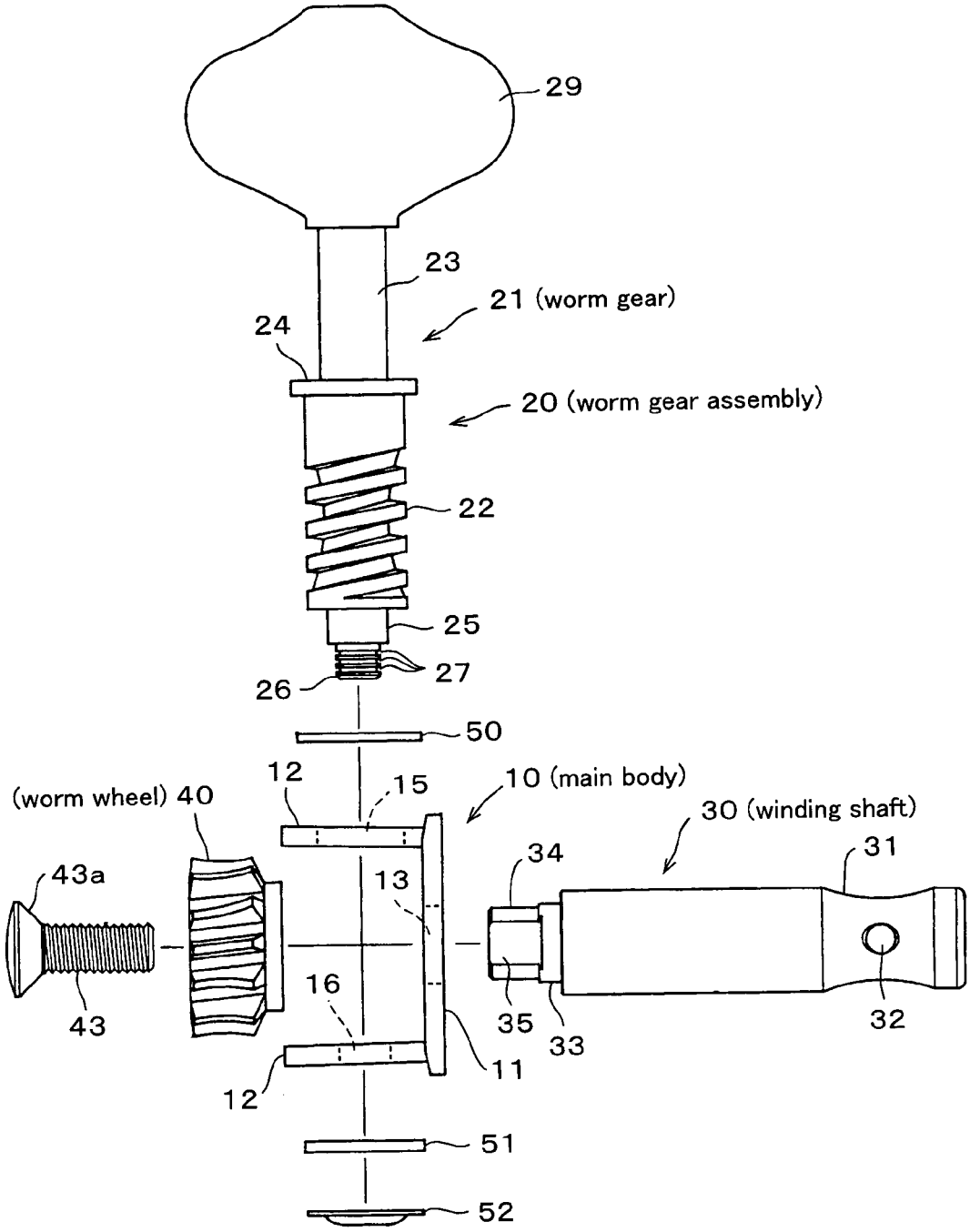
FIG. 1 is an assembly view of a peg of an embodiment of the present invention.
Figure 2:
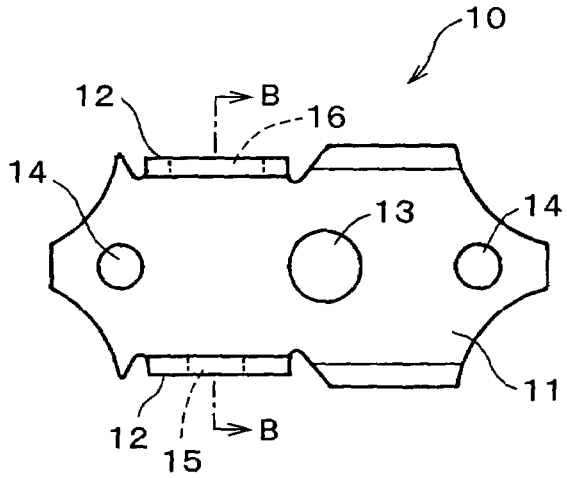
FIG. 2 is a plan view of the main body of the embodiment.

FIG. 1 is an assembly view of a peg of an embodiment. In FIG. 1, reference numeral 10 indicates a main body, reference numeral 20 indicates a worm gear assembly, reference numeral 30 indicates a winding shaft, and reference numeral 40 indicates a worm wheel. These structures will be described in order. FIG. 2 is a plan view of the main body 10. As shown in this figure, the main body 10 in plan view has a substantially rectangular shape and is basically formed of a flat base portion 11, and bearings 12 are erected at both sides of the base 11. A support hole 13 is formed in the base 11 for rotatably supporting the winding shaft 30. Also holes 14 are formed in the base 11 for mounting the peg to the head of a classical guitar with screws.

A large diameter hole 15 is formed in one bearing 12 for rotatably supporting the base portion of the worm gear assembly 20, a small diameter hole 16 is formed in the other bearing 12 for rotatably supporting a leading end of the worm gear assembly 20. As shown in FIG. 3B, the bearings 12 are respectively inclined outwards with respect to the base 11. The angle of inclination is a maximum of 6° with respect to the vertical direction of FIG. 3B.

Figure 3A:
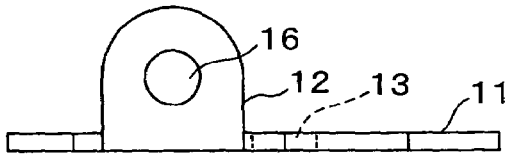
FIG. 3A is a side view of the main body of the embodiment.
Figure 3B:
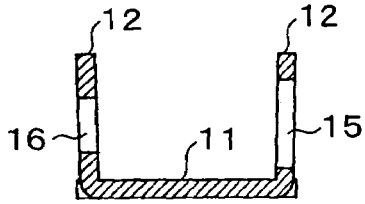
FIG. 3B is a cross-sectional view taken along line B—B in FIG. 2.
Figure 4A:
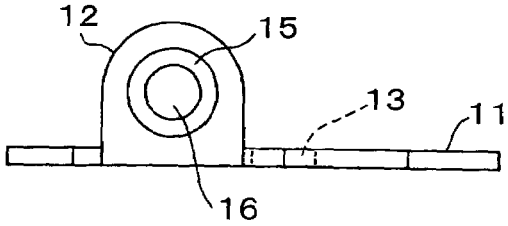
FIG. 4A is side view of a main body which corresponds to that of FIG. 3.
Figure 4B:
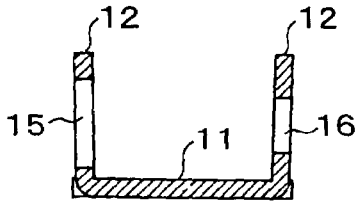
FIG. 4B is a cross sectional view thereof.

It should be noted that the main body shown in FIGS. 2, 3A, and 3B is to be mounted to one side of the guitar head and that shown in FIGS. 4A and 4B is to be mounted to the other side and corresponds to that of FIGS. 2, 3A and 3B. The main body 10 having the structure described in the foregoing is formed as one body by pressing an ordinary SPC steel plate and the like, and is subsequently carburized to thereby impart spring-like properties.

Figure 5:
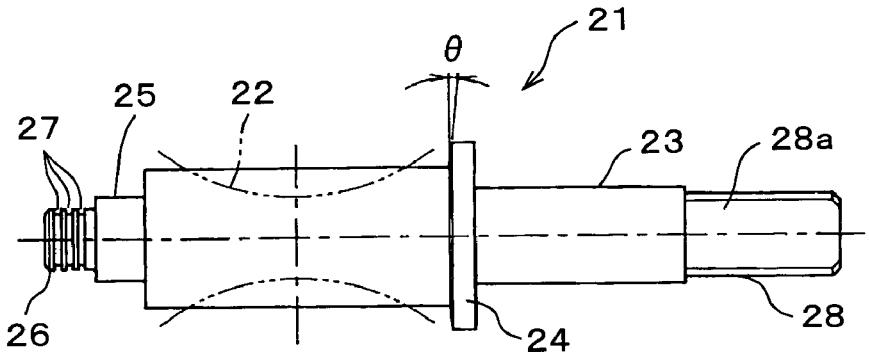
FIG. 5 is a side view of the worm gear of the embodiment.

FIG. 5 is a side view of the worm gear 21. The worm gear 21 is basically composed of the worm 22 and the worm shaft 23. A flange 24 is formed between the worm 22 and the worm shaft 23. The end surface of the flange 24 at the worm 22 side is tapered, and the taper angle θ is 6° or less. At one end portion of the worm 22, a small diameter hole 16 of the bearing 12 and a small diameter shaft 25 which fits therein so as to be rotatable are formed. At the leading end portion of the small diameter shaft 25, an engagement portion 26 with an even smaller diameter is formed. Plural grooves 27 are formed so as to be spaced apart and extend along the entire outer periphery of the engagement portion 26. In addition, at the other end portion of the worm 23, a mounting portion 28 which has a smaller diameter than the worm 23 is formed, and flat notches 28*a* are formed at both side surfaces of the mounting portion 28. In addition, as shown in FIG. 1, knobs 29 are mounted at the mounting portion 28 in a state in which they are engaged to the rotation direction with the notches 28*a,* and they are fixed by an appropriate means such as bonding.

As shown in FIG. 1, at one end portion of the winding shaft 30, a winding surface 31 is formed whose center has a reduced diameter and is thus shaped like an hourglass. A through hole 32 is formed in the center of the winding surface 31, and one end portion of the string is passed through the through hole 32 and the string is then wound onto the winding shaft 30 therefrom. Also, the support hole 13 for the main body 10 and the small diameter shaft 33 which fits therein so as to be rotatable, is formed at the other end portion of the winding shaft 30. A mounting shaft 34 with an even smaller diameter is formed at the leading end portion of the small diameter shaft 33, and in addition, flat notches 35 are formed at both side surfaces of the mounting shaft 34.

Figure 6:
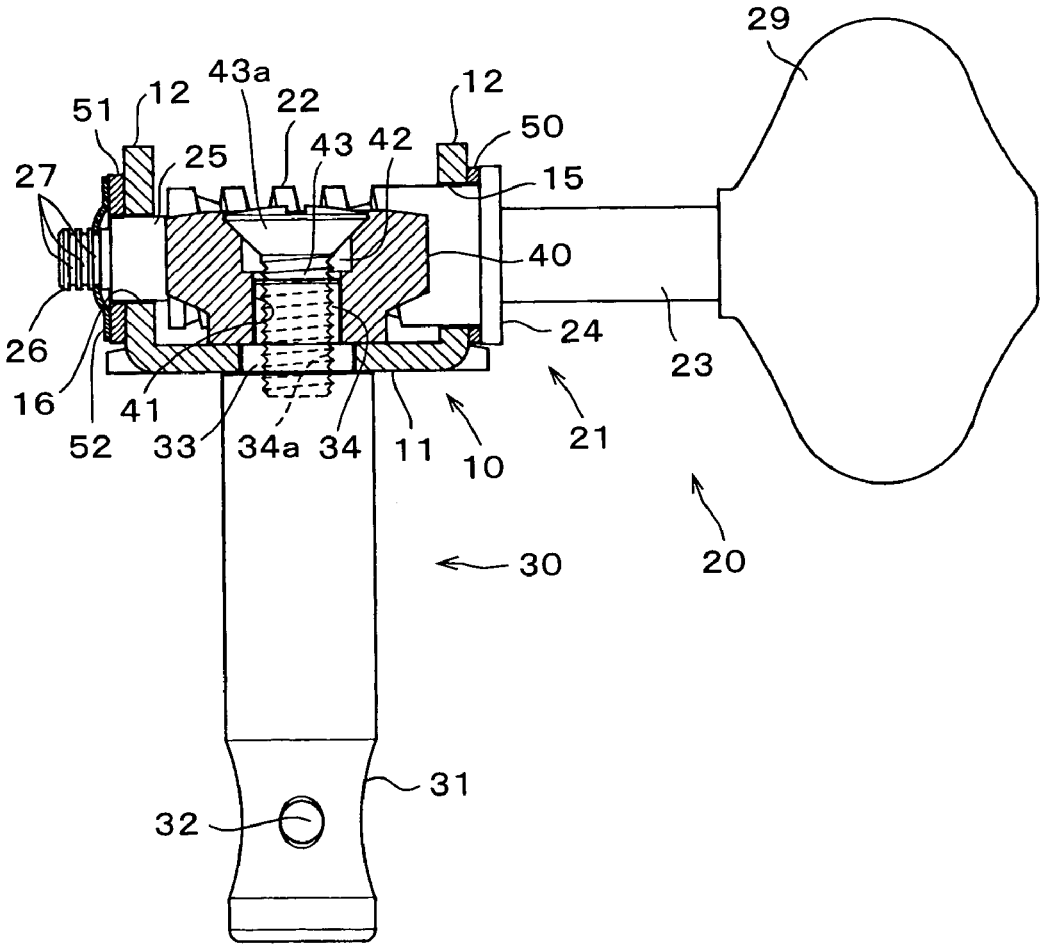
FIG. 6 is a lateral partial cross-sectional view of the peg of the embodiment.

The worm wheel 40 meshes with the worm 22. A hole 41, into which the mounting shaft 34 of the winding shaft 30 fits, is formed in the center of one end portion of the worm wheel 40 (see FIG. 6), and the hole 41 engages with the notch 35 of the mounting shaft 34 in the direction of rotation. Also, a counter-bore 42 which has a larger diameter than that of the hole 41, is formed at the center of the other end portion of the worm wheel 40. The worm wheel 40 is accommodated in the hole 42 which seats the head portion 43*a*, and is mounted to the winding shaft 30 so as to nip the base 11, using screws 43 which are engaged in screw holes 34*a* of the mounting shaft 34. In FIGS. 1 and 6, reference numerals 50 and 51 indicate washers and reference numeral 52 indicates a push nut. The washers 50 and 51 are formed of a synthetic resin.

When the peg having the above-described structure is assembled, the washer 50 of the peg in the state shown in FIG. 1 is inserted through the worm gear assembly 20, and the worm gear assembly 20 is inserted through the large diameter hole 15 of the bearing 12. Then, the small diameter shaft 25 of the worm gear 21 is fit into the small diameter hole 16 of the bearing, and the washer 51 is fit into the small diameter shaft 25 and the push nut 52 is pressure inserted into the engagement portion 26. As a result, the inner periphery of the push nut 52 is engaged with the groove 27, and the push nut 52 is in a state in which it cannot become disengaged therefrom. Next, the small diameter shaft 33 of the winding shaft 30 is engaged with the support hole 13 of the main body 10, and the mounting shaft 34 of the winding shaft 30 is fit into the hole 41 of the worm wheel 40. Then, the screw 43 is screwed into the screw hole 34*a* of the mounting shaft 34, thus completing the assembly of the peg.

A peg which has been assembled as described in the foregoing is shown in FIG. 6. As shown in FIG. 6, by the push nut 52 being pressure-inserted into the engagement portion 26, the bearings 12 and 12 are secured between the flange 24 of the worm gear 21 and the push nut 52, and are substantially parallel to each other due to elastic deformation. In this state, when the thrust load acts upon the worm gear 21, the thrust load is applied to the bearing 12 via the flange 24 or the push nut 52. In the peg having the above structure, the bearing 12 is formed of a spring material (an elastic material), and furthermore the large diameter hole 15 and the small diameter hole 16 which supports the worm gear 21, are formed as round holes. As a result, it is difficult for the bearing 12 to be deformed. Accordingly, it is difficult for the worm gear 21 and the bearing 12 to have play, and thus it is unlikely that problems will arise such as increased backlash and unusual noises or for the notes to become out of tune due to rotation of the worm gear 21 in the wrong direction.

In particular, in the embodiment described above, by the push nut 52 being pressure-inserted, the bearings 12 and 12 are caused to elastically deform towards the inside, and thus frictional resistance with the worm gear 21 is caused by the repulsive force due to the spring-like property of the bearing 12. As a result, the play of the bearing 12 and the worm gear 21 in the direction of thrust is eliminated, and also when the knob 29 is rotated, a suitable amount of resistance is generated, and thus tuning is made easy. In addition, even if vibrations are transmitted to the worm gear 21, problems such as unusual noises and rotation of the winding shaft 30 in the wrong direction are controlled. Furthermore, since synthetic resin washers 50 and 51 are placed between the flange 24 and the bearing 12, as well as between the push nut 52 and the bearing 12, surface contact of the metal portions with each other is prevented, and seizing due to sliding contact of the surfaces when the worm gear rotates is prevented, and also a soft and smooth feel can be obtained when the stringed instrument is being tuned.

Furthermore, in this embodiment, the bearings 12 are inclined so as to extend outwards with respect to the base portion 11, and they are disposed so as to be substantially parallel to each other by the push nut 52 being pressure inserted. As a result, the repulsive force due to the spring-like properties of the bearing 12 acts directly in the axial direction, thus efficiently generating frictional resistance with the worm gear 21. Also, the worm gear 21 is fit into the large diameter hole 15 and the small diameter hole 16 of the bearing 12 when the holes are in a state of being perfectly round, and thus the characteristics of the bearing can be favorably maintained.

Furthermore, in this embodiment, because the push nut 52 engages with the grooves 27 on the worm gear 21, the worm gear 21 is prevented from becoming disengaged from the bearing 12, and the setting of the securing force in the thrust direction can be carried out in a single operation, thus reducing the number of steps in the assembly process. In addition, as shown in FIGS. 1 to 6, by serially providing a plurality of grooves 27, the securing force can be suitably adjusted in the direction of thrust, and thus the positions and also the interval between the grooves can be precisely controlled, and by carrying out standardization such that a particular push nut 52 will be engaged with a particular groove 27, the securing force in the thrust direction of the bearing can be made uniform, thus improving the uniformity of the product.

Figure 7:
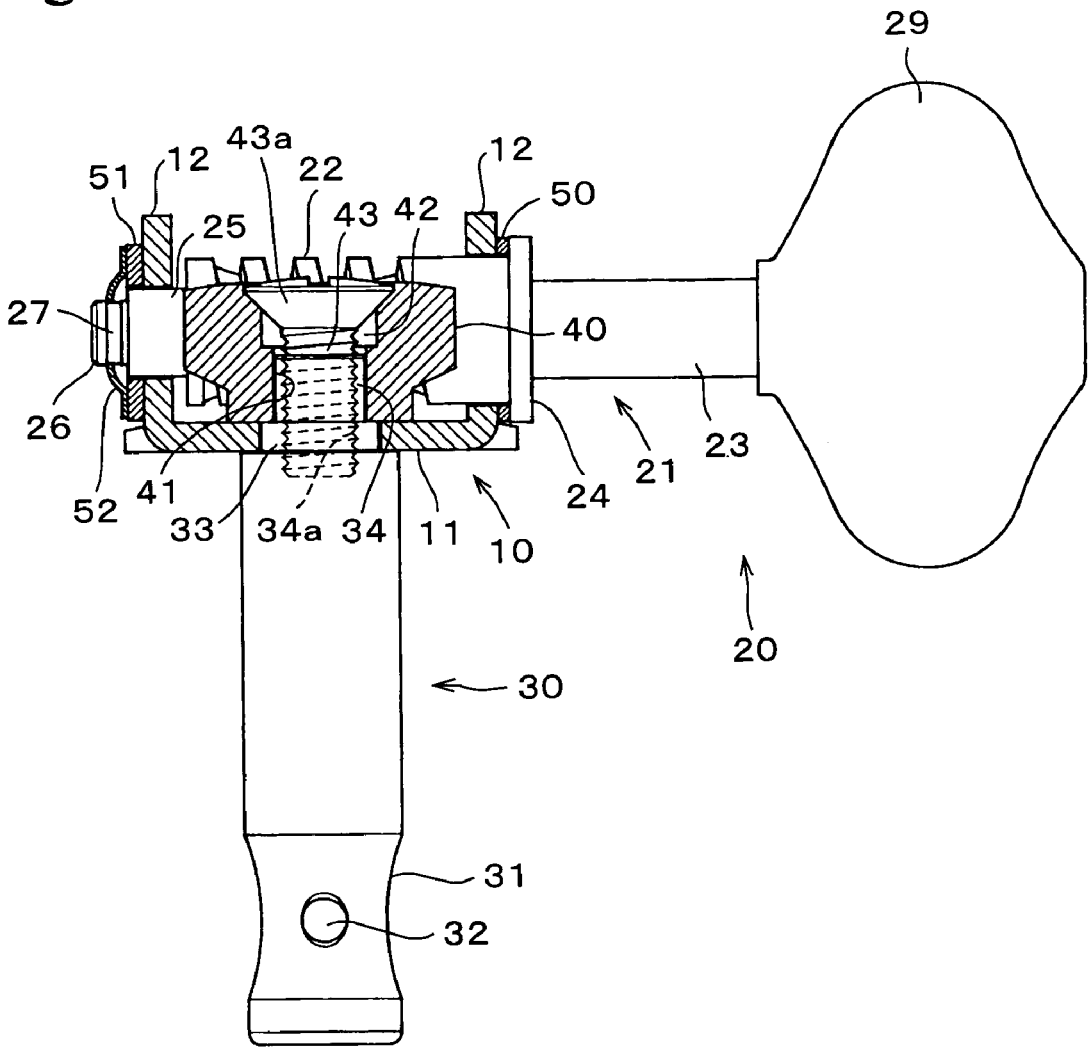
FIG. 7 is a lateral partial cross-sectional view of the peg of another embodiment of the present invention.
Figure 8:
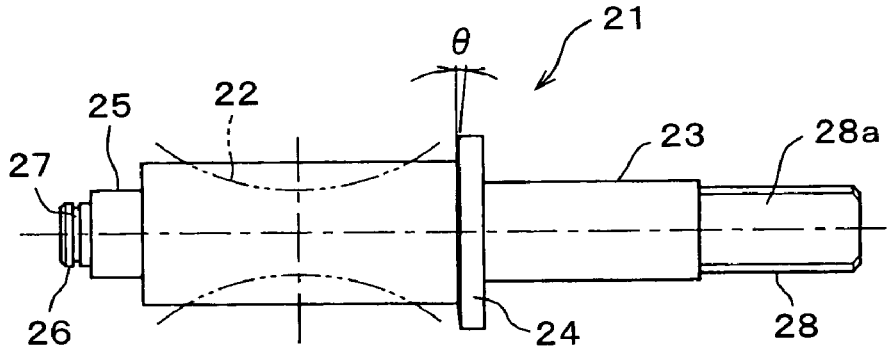
FIG. 8 is a side view of the worm gear of the embodiment.
Figure 9:
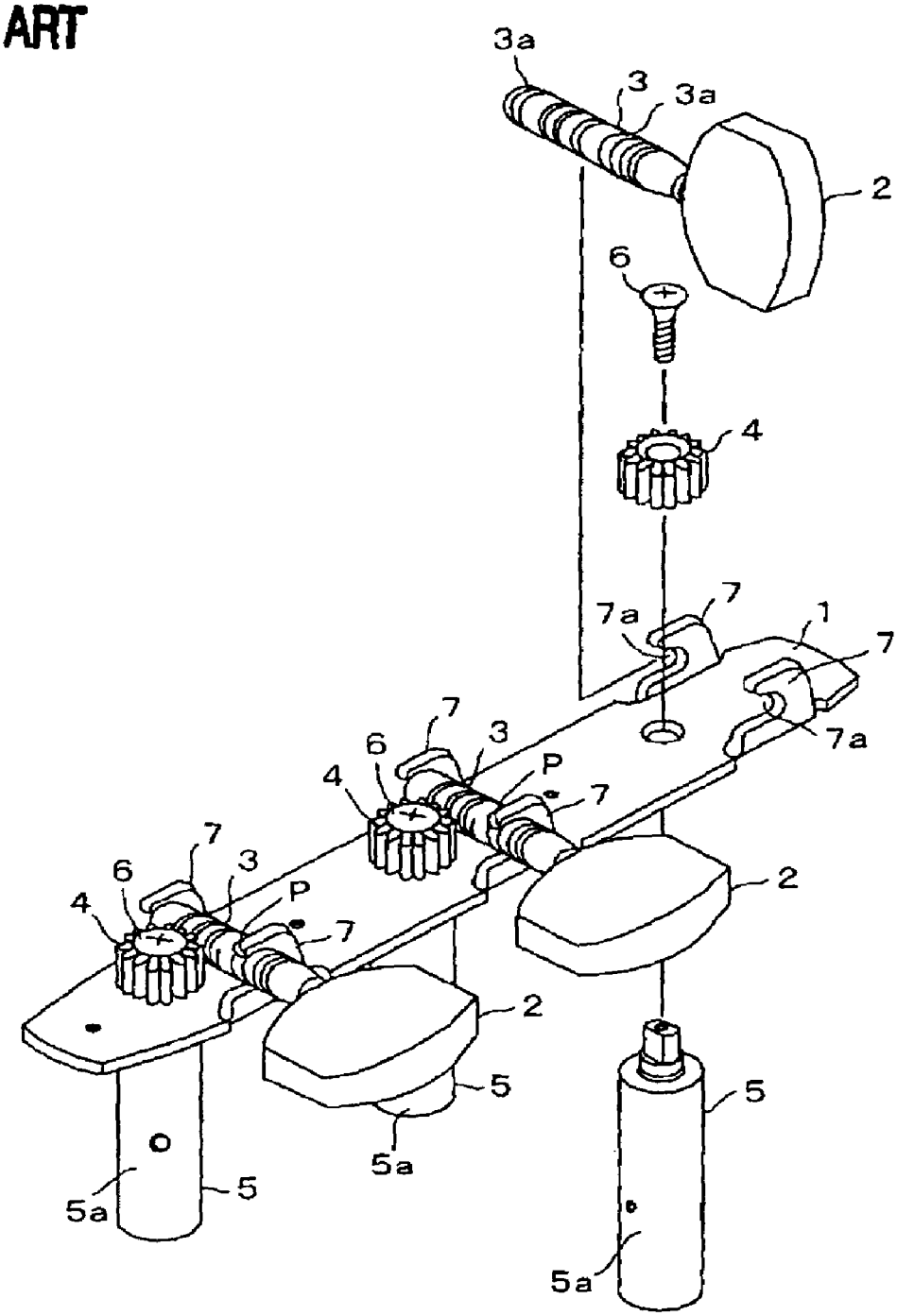
Fig. 9 PRIOR ART
FIG. 9 is a perspective view of a conventional peg.

FIGS. 7 and 8 show another embodiment of the present invention. The only difference between this embodiment and the previous embodiment is that one groove 27 is formed at the outer periphery of the engagement portion 26 of the worm gear 21. The parts which are the same as those of the previous embodiment are assigned the same reference numerals. The same operation and effects obtained in the previous embodiment are obtained in this embodiment as well, except for those caused by the plural grooves 27 being provided.

In the inventions described above, because the bearing is formed of a material having a spring-like properties, the following can be achieved without increasing the manufacturing cost: the transformation of the bearing in the direction of thrust is controlled, and play between the worm gear and the bearing in the direction of thrust is eliminated, and accordingly tuning is facilitated and problems of the generation of unusual noises and reverse rotation of the worm gear do not occur.

What is claimed is:

1. A peg for a stringed instrument, comprising:

a main body for mounting the peg to a head portion of the stringed instrument, the main body having through holes through which screws are inserted and tightened to the head to mount the main body to the head, a pair of bearings integrally formed with the main body and erected at both sides of the main body so as to oppose each other;

a worm gear having two ends which are rotatably supported in round holes disposed so as to oppose each other on the pair of bearings;

a knob provided at an end portion of the worm gear; and a winding shaft connected to the worm gear via a worm wheel, wherein the bearing are formed of a material having spring properties;

wherein the bearings are inclined with respect to the base portion so as to open slightly outwards in a direction in which they are erected, and a tightening means for tightening the bearing to the worm gear from both sides thereof are provided at both ends of the worm gear, wherein the tightening means elastically deforms the bearing, whereby frictional force between the bearings and the worm gear is generated by repulsive force caused by spring properties of the bearings.

2. A peg for a stringed instrument, according to claim 1, wherein the tightening means comprises a flange portion disposed at a base end portion side of the worm gear and a push nut which is press-inserted into a leading end of the worm gear, the leading end of the worm gear having at least one groove extending along a peripheral direction thereof, the groove engaging with an inner periphery of the push nut.

3. A peg for a stringed instrument, according to claim 2, further comprising a washer comprising a synthetic resin or a metal, the washer having a lubrication coating on a surface thereof, the washer disposed between the flange portion and the bearing, and between the push nut and the bearing.

4. A method for manufacturing a peg for a stringed instrument, comprising the steps of:

press forming a plate metal composed of an ordinary steel plate so as to form a main body in which bearings having round holes are erected from both sides thereof so as to oppose each other;

subjecting the main body to carburization so as to provide spring properties to the bearings;

subjecting the main body to a finishing process such as plating;

rotatably mounting to the bearing having the round holes, a worm gear having a knob at one end thereof; and mounting a winding shaft including a worm wheel meshing with the worm gear to the main body.

5. A peg for a stringed instrument, comprising:

a main body for mounting the peg to a head portion of the stringed instrument, the main body having through holes through which screws are inserted and tightened to the head to mount the main body to the head;

a pair of bearings integrally formed with the main body and erected at both sides of the main body so as to oppose each other;

a worm gear having two ends which are rotatably supported in round holes disposed so as to oppose each other on the pair of bearings;

a knob provided at an end portion of the worm gear; and a winding shaft connected to the worm gear via a worm wheel, wherein the bearings are formed of a material having spring properties;

wherein the bearings are inclined with respect to the base portion so as to open slightly outwards in a direction in which they are erected, and wherein the peg further comprising a tightening means for tightening the bearing to the worm gear from both sides thereof provided at both ends of the worm gear; and wherein the tightening means comprises a flange portion disposed at a base end portion side of the worm gear and a push nut which is press-inserted into a leading end of the worm gear, the leading end of the worm gear having at least one groove extending along a peripheral direction thereof, the groove engaging with an inner periphery of the push nut.

6. A peg for a stringed instrument, according to claim 5, further comprising a washer comprising a synthetic resin or a metal, the washer having a lubrication coating on a surface thereof, the washer disposed between the flange portion and the bearing, and between the push nut and the bearing.

* * * * *